US010156121B2

(12) United States Patent
Nguyen

(10) Patent No.: US 10,156,121 B2
(45) Date of Patent: Dec. 18, 2018

(54) TESTABLE BACKPRESSURE VALVE SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 578 days.

(21) Appl. No.: 14/792,603

(22) Filed: Jul. 6, 2015

(65) Prior Publication Data

US 2017/0009555 A1 Jan. 12, 2017

(51) Int. Cl.
*E21B 33/02* (2006.01)
*E21B 34/02* (2006.01)
*E21B 23/00* (2006.01)

(52) U.S. Cl.
CPC ..... *E21B 34/02* (2013.01); *E21B 23/00* (2013.01)

(58) Field of Classification Search
CPC ..... E21B 33/04; E21B 33/03; E21B 33/02; E21B 34/02
See application file for complete search history.

(56) References Cited

U.S. PATENT DOCUMENTS 3,095,929 A * 7/1963 McGuire ..... E21B 33/04 166/88.4
3,123,517 A * 3/1964 Davis ..... E21B 21/10 137/68.23
3,870,104 A * 3/1975 Mott ..... E21B 34/106 166/208
3,976,136 A * 8/1976 Farley ..... E21B 34/10 166/264
4,373,380 A * 2/1983 Mayo ..... E21B 33/035 73/40.5 R
4,901,761 A * 2/1990 Taylor ..... E21B 21/08 137/557
5,148,870 A 9/1992 Fernandez et al.
5,170,845 A * 12/1992 Gay ..... E21B 34/105 166/324
5,205,355 A * 4/1993 Gay ..... E21B 34/105 166/382
7,062,960 B2 * 6/2006 Couren ..... E21B 33/061 73/152.51
8,539,976 B1 9/2013 Rodgers, Jr. et al.
8,636,058 B2 * 1/2014 Nguyen ..... E21B 23/01 166/325
2010/0326664 A1 * 12/2010 Neto ..... E21B 33/04 166/336
2014/0034392 A1 * 2/2014 Ganzinotti, II ..... E21B 7/20 175/57
2014/0182863 A1 7/2014 Nguyen et al.

OTHER PUBLICATIONS

PCT International Search Report and Written Opinion; Application No. PCT/US2016/039672; dated Oct. 27, 2016; 13 pages.

* cited by examiner

*Primary Examiner* — Kipp C Wallace
(74) *Attorney, Agent, or Firm* — Fletcher Yoder, P.C.

(57) ABSTRACT

A system including a backpressure valve (BPV) system configured to mount in a hydrocarbon extraction system, wherein the BPV system includes a body comprising a vent port and a test passage, and a plunger configured to form a seal with the body around the vent port wherein the BPV system is configured to test the seal by pumping a fluid into the body through the test passage.

20 Claims, 4 Drawing Sheets

TESTABLE BACKPRESSURE VALVE SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Drilling systems use a variety of components to drill, extract, and transport oil and natural gas. Some of these components may include seals and valves that regulate pressures and/or fluid flow in the drilling systems. For example, a drilling system may include a tubing hanger or casing hanger within a wellhead. In operation, the hanger generally regulates pressures and provides a path for hydraulic control fluid, chemical injections, etc. to pass through the wellhead and into the well bore. In such a system, a backpressure valve is often disposed in a central bore of the hanger. The backpressure valve plugs the central bore of the hanger to block pressures of the well bore from passing through the wellhead. Unfortunately, existing backpressure valves do not enable seal testing during installation.

BRIEF DESCRIPTION OF THE DRAWINGS

Various features, aspects, and advantages of the present disclosure will become better understood when the following detailed description is read with reference to the accompanying figure, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The present embodiments disclose a backpressure valve (BPV) system that enables seal testing during installation. By seal testing during installation, the BPV system may reduce the time, steps, and effort involved during the installation process (e.g., one trip installation). For example, the BPV system enables the same running tool that lowered the BPV in position to seal test before uncoupling and withdrawing the running tool, thus reducing the time and steps involved in resending the running tool to recover the BPV system if it is not working properly. In order to seal test the BPV system, the BPV system includes a body that houses first and second seal pistons. In operation, axial movement of the first seal piston aligns a test passage with a fluid passage in the running tool, while axial movement of the second seal piston forms a test chamber. Once aligned, fluid is pumped through the running tool and into the test chamber to seal test the BPV systems. If the BPV system seals, the running tool uncouples and withdraws, but if not the running tool may uncouple and withdraw the BPV system for maintenance before attempting to reinstall.

Figure 1:
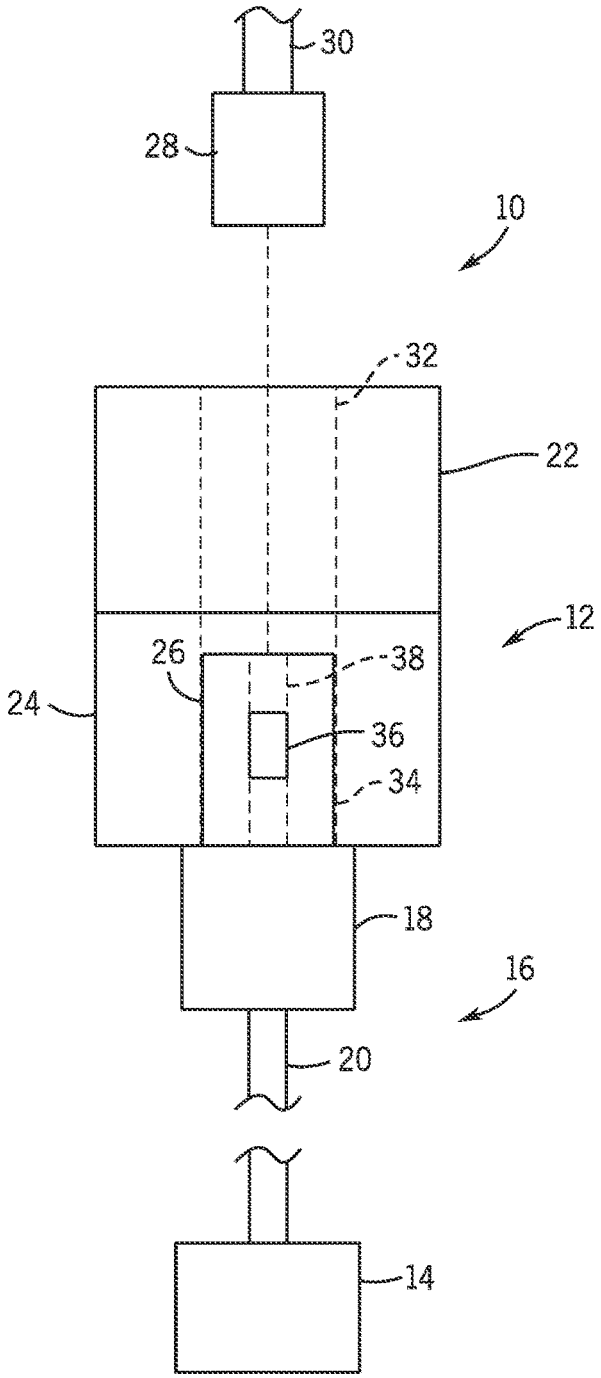
FIG. 1 is a block diagram of an embodiment of a hydrocarbon extraction system with a backpressure valve system.

FIG. 1 is a block diagram that illustrates a hydrocarbon extraction system 10. The illustrated hydrocarbon extraction system 10 can be configured to extract various minerals and natural resources, including hydrocarbons (e.g., oil and/or natural gas), or configured to inject substances into the earth. In some embodiments, the hydrocarbon extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well bore 20. The wellhead hub 18 provides for the connection of the wellhead 12 to the well 16. For example, the wellhead 12 includes a connector that is coupled to a complementary connector of the wellhead hub 18.

The wellhead 12 typically includes multiple components that control and regulate activities and conditions associated with the well 16. For example, the wellhead 12 generally includes bodies, valves and seals that route minerals (e.g., oil and/or natural gas) from the mineral deposit 14, regulate pressure in the well 16, and inject chemicals into the well bore 20 (down-hole). In the illustrated embodiment, the wellhead 12 includes what is colloquially referred to as a Christmas tree 22, a tubing spool 24, and a hanger 26 (e.g., a tubing hanger or a casing hanger).

The system 10 may include other devices that couple to the wellhead 12, and devices that control various components of the wellhead 12. For example, in the illustrated embodiment, the system 10 includes a tool 28 (e.g., running tool, retrievable tool) suspended from a rod or string 30. In certain embodiments, the tool 28 is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities.

The tubing spool 24 provides a base for the wellhead 24 and/or an intermediate connection between the wellhead hub 18 and the tree 22. Typically, the tubing spool 24 is one of many components in a modular subsea or surface hydrocarbon extraction system 10 that is run from an offshore vessel or surface system. The tubing spool 24 includes the tubing spool bore 34. The tubing spool bore 34 connects (e.g., enables fluid communication between) the tree bore 32 and the well 16. Thus, the tubing spool bore 34 may provide access to the well bore 20 for various completion and workover procedures. For example, components can be run down to the wellhead 12 and disposed in the tubing spool bore 34 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, hydrocarbon extraction systems 10 employ various mechanisms, such as seals, plugs, and valves, to control and regulate the well 16. For example, the hydrocarbon extraction system 10 may include a backpressure valve (BPV) system 36 (e.g., check valve system) that regulates the flow and pressures of fluids in various bores and channels throughout the hydrocarbon extraction system 10. As illustrated, the hanger 26 (e.g., tubing hanger or casing hanger) is disposed within the wellhead 12 to secure tubing and casing suspended in the well bore 20, and to provide a path for hydraulic control fluid, chemical injections, and the like. The hanger 26 includes a hanger bore 38 that extends through the center of the hanger 26, and that is in fluid communication with the tubing spool bore 34 and the well bore 20. As will be appreciated, pressures in the bores 20 and 34 may manifest through the wellhead 12 if not regulated. The backpressure valve system 36 is therefore seated and locked in the hanger bore 38 to regulate the pressure. Similar backpressure valve systems 36 may be used throughout hydrocarbon extraction systems 10 to regulate fluid pressures and flows. In operation, the hanger 26 may be run down and installed into the wellhead 12 (e.g., surface or subsea wellhead), followed by the installation of the backpressure valve system 36 with the running tool 28.

Figure 2:
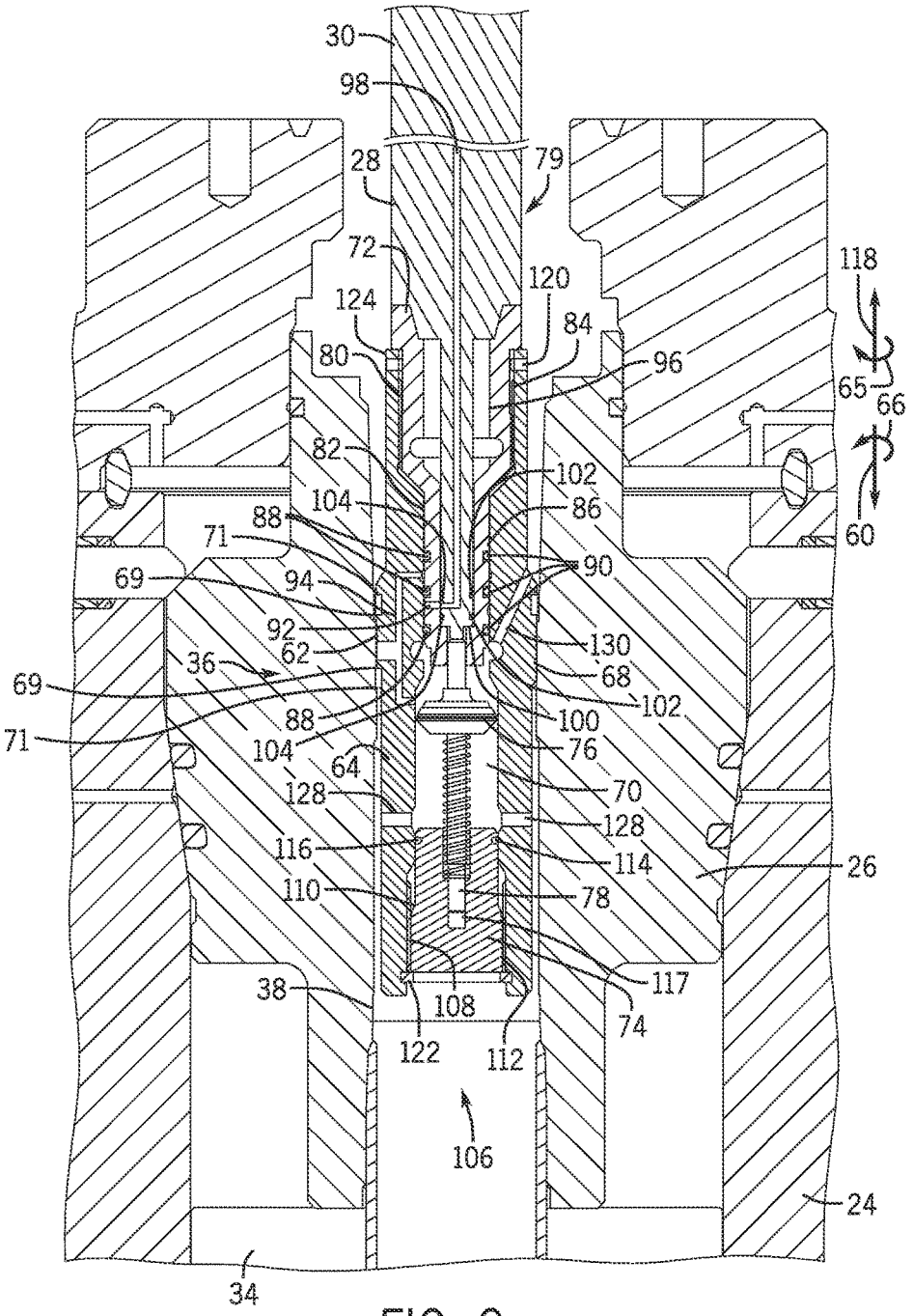
FIG. 2 is a cross-sectional side view of an embodiment of a backpressure valve system in an open position.

FIG. 2 is a cross-sectional side view of an embodiment of a backpressure valve system (BPV) 36 in an open position. As illustrated, the BPV system 36 couples to a running tool 28 that enables the rod or string 30 to lower the BPV system 36 in axial direction 60. Once in position, the BPV system 36 couples to the hanger 26 using threads 62 on a BPV body 64. In other words, once the rod or string 30 lowers the BPV system 36 into position, the rod or string 30 rotates the running tool 28 in either circumferential direction 65 or 66 to couple the threads 62 on the body 64 to the threads 68 on the hanger 26. As the threads 62 and 66 couple together, the BPV system 36 seals in the hanger bore 38 of the hanger 26 using one or more seals 69 (e.g., circumferential seals) that rest in grooves 71 (e.g., circumferential grooves).

As illustrated, the BPV system 36 includes an aperture 70 (e.g., passage, cavity, etc) through the body 64. The aperture 70 enables the body 64 to receive a first seal piston 72, a second seal piston 74, a sealing plunger 76, and a connecting rod 78. Together the first seal piston 72, second seal piston 74, sealing plunger 76, and connecting rod 78 open and close the BPV system 36 to enable fluid flow, block fluid flow, and to test sealing of the BPV system 36 within the hanger 26.

The first seal piston 72 couples to a first end 79 of the body 64 using threads 80 on an exterior surface 82 that couple to threads 84 on an interior surface 86 of the body 64. In operation, the threading engagement between the first seal piston 72 and the body 64 enables the first seal piston 72 to move axially in response to rotation by the running tool 28. As will be explained below, axial movement of the first seal piston 72 in response to rotation by the running tool 28 opens, closes, and enables testing of the BPV system 36.

In order to form a seal between the first seal piston 72 and the body 64, the first seal piston 72 may include axially spaced annular seals 88 that rest in circumferential grooves 90 on the exterior surface 82 of the first seal piston 72. In some embodiments, BPV system 36 may use annular grooves 90 in the body 64 that receive the seals 88. In still other embodiments, the body 64 and first seal piston 72 may have annular grooves 90 with seals 88. In operation, the seals 88 block fluid flow between the first seal piston 72 and the body 64 by controlling fluid flow between a radial fluid port 92 (e.g., test port) in the first seal piston 72 and a fluid passage 94 (e.g., test passage) in the body 64.

The running tool 28 couples to and rests within an aperture 96 of the first seal piston 72. As will be explained in more detail below, the running tool 28 includes a fluid passage 98 (e.g., axial and radial) that enables a testing fluid to enter the BPV system 36 when the fluid port 92 aligns with the fluid passage 94. In order to align the fluid passage 98 with the fluid port 92, the first seal piston 72 may include an annular ledge 100 (e.g., landing, protrusion) that blocks over insertion of the running tool 28 in axial direction 60. Moreover, to control fluid flow, the running tool 28 may include annular seals 102 in annular grooves 104 that direct fluid flow from the fluid passage 98 and into the fluid port 92. In some embodiments, the first seal piston 72 may include the grooves 104 that receive the seals 102. In still other embodiments, the running tool 28 and the first seal piston 72 may include grooves 104 and seals 102 that direct fluid from the fluid passage 98 into the fluid port 92.

As illustrated, the second seal piston 74 couples to a second end 106 of the body 64. The second seal piston 74 couples to the body 64 using threads 108 on an exterior surface 110 that couple to threads 112 on the interior surface 86 on the body 64. In order to seal with the body 64, the second seal piston 74 includes a annular seal 114 within an annular groove 116 that sealingly engages the interior surface 86 of the body 64. In some embodiments, the second seal piston 74 may include additional seals 114 and grooves 116 (e.g., 1, 2, 3, 4, 5, or more) that sealingly engage the interior surface 86 of the body 64.

As illustrated, the first and second seal pistons 72 and 74 couple together with a connecting rod 78 (e.g., shaft). For example, the connecting rod 78 may rest within an aperture 96 of the first seal piston 72 and within an aperture 117 of the second seal piston 74. In order to transfer torque between the first and second pistons seals 72, 74, the cross-sectional shape of the connecting rod 78 and apertures 96, 117 may be square, rectangular, oval, or another shape that blocks rotation (e.g., anti-rotation feature) of the connecting rod 78 relative to the first and second seal pistons 72, 74. However, in some embodiments, the connecting rod 78 may be circular with an anti-rotation feature (e.g., a pin or protrusion in an axial slot), to the first and second seal pistons 72, 74 in a way that blocks relative rotation between the first and second seal pistons 72, 74 and the connecting rod 78.

In operation, the connecting rod 78 transfers torque from the first seal piston 72 to the second seal piston 74 as the running tool 28 rotates the first seal piston 72 in either circumferential direction 65 or 66. For example, when the running tool 28 rotates the first seal piston 72, the first seal piston 72 transfers that rotation to the connecting rod 78. The connecting rod 78 then rotates the second seal piston 74 in the same direction. Accordingly, as the first seal piston 72 moves in axial direction 118, the second seal piston 74 moves in axial direction 118. Likewise, when the running tool 28 threads into the body 64 in axial direction 60, the connecting rod 78 rotates the second seal piston 74, which drives the second seal piston 74 in axial direction 60.

In order to block the first and second pistons 72, 74 from uncoupling from the body 64, the BPV system 36 may include one or more stop pins 120 (e.g., 1, 2, 3, 4, 5 or more) and/or a retaining ring 122 (e.g., c-ring). For example, the BPV system 36 may include one or more stop pins 120 that extend into aperture 70 of the body 64 through apertures 124 in the body 64. In operation, the stop pins 120 block removal of the first seal piston 72 as the first seal piston 72 threads in and out of the body 64 in axial directions 60, 118. Similarly, the BPV system 36 may use the retaining ring 122 to block uncoupling of the second seal piston 74 from the body 64. As illustrated, the retaining ring 122 rests within a groove 126 (e.g., annular groove) and extends into the aperture 70 of the body 64. In this position, the retaining ring 122 blocks removal of the second seal piston 74 from the body 66 in axial direction 60.

In the open position, the first seal piston 72 is threaded into the body 64 enabling fluid flow through the BPV system 36 and thus through the hanger 26. As illustrated, the body 64 may include one or more apertures 128 (e.g., radial apertures) that enable fluid to flow from the bore 34 and into the aperture 70 in the body 64. After passing through the apertures 128, the fluid flows around the plunger 76 before exiting through one or more apertures 130 (e.g., vent port). Furthermore, in the open position, the first seal piston 72 misaligns the fluid port 92 with the fluid passage 94, thus blocking test fluid from flowing through the running tool 28 and into the aperture 70.

Figure 3:
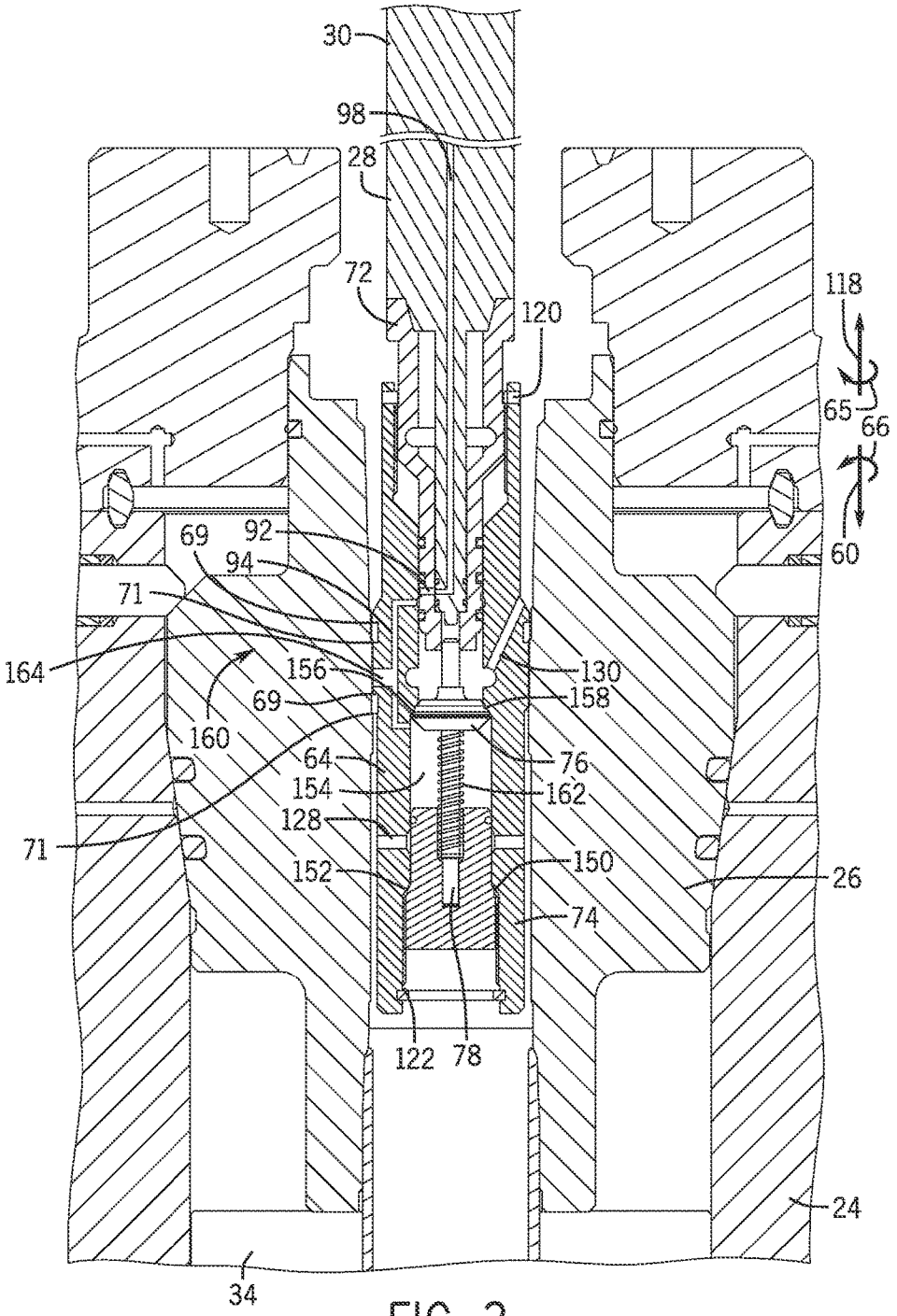
FIG. 3 is a cross-sectional side view of an embodiment of a backpressure valve system in a test position.

FIG. 3 is a cross-sectional side view of an embodiment of a BPV system 36 in a test position. In order to test the BPV system 36, the running tool 28 rotates the first seal piston 72 in either circumferential direction 65 or 66, depending on thread orientation. As the first seal piston 72 rotates, the first seal piston 72 transfers torque to the second seal piston 74 through the connecting rod 78. As the first and second seal pistons 72, 74 rotate, they move in axial direction 118. The running tool 28 may continue to rotate until the threads 80 on the first seal piston 72 contact the stop pins 120 and/or a surface 150 (e.g., circumferential surface, circumferentially tapered surface) on the second seal piston 74 contacts a ledge 152 (e.g., protrusion(s), ridge, landing) in the aperture 70 of the body 64.

As the second seal piston 74 moves in axial direction 118, the second seal piston 74 covers (i.e., blocks fluid flow through) the apertures 128 in the body 64. Moreover, the movement in axial direction 118 drives the connecting rod 78 and plunger 76 in axial direction 118 to form a seal with the body 64, which blocks fluid flow through the aperture(s) 130 and forms an annular test chamber 154. For example, the plunger 76 may include a circumferential surface 156 (e.g., tapered) that contacts a corresponding surface 158 (e.g., tapered) on the conical body 64, which forms a sealing interface 160. As illustrated, the plunger 76 surrounds the connecting rod 78 and is able to move (e.g., slide) on the connecting rod 78 in axial directions 60, 118. In order to maintain contact and/or drive the plunger 76 into contact with the surface 158, the BPV system 36 includes one or more springs 162 (e.g., 1, 2, 3, 4, 5, or more) that surround the connecting rod 78. The spring(s) 162 provides a biasing force in axial direction 118 that drives the plunger 76 into contact with the body 64 to form the seal interface 160.

While the second seal piston 72 forms the test chamber 154, the first seal piston 72 moves in axial direction 118, which aligns the fluid port 92 with the fluid passage 94. In this position, test fluid may be pumped through the fluid passage 98, in the running tool 28, and into the test chamber 154 to test the seal interface 160. In this way, the BPV system 36 may be lowered and tested with the running tool 28 in a single trip before the running tool 28 is withdrawn and the BPV system 36 is used in hydrocarbon extraction operations. In some embodiments, the BPV system 36 may include an exterior seal test port 164 (e.g., radial) that fluidly couples to the test passage 94. In operation, the exterior seal test port 164 enables simultaneous testing of the seals 69 while seal testing the seal interface 160.

Figure 4:
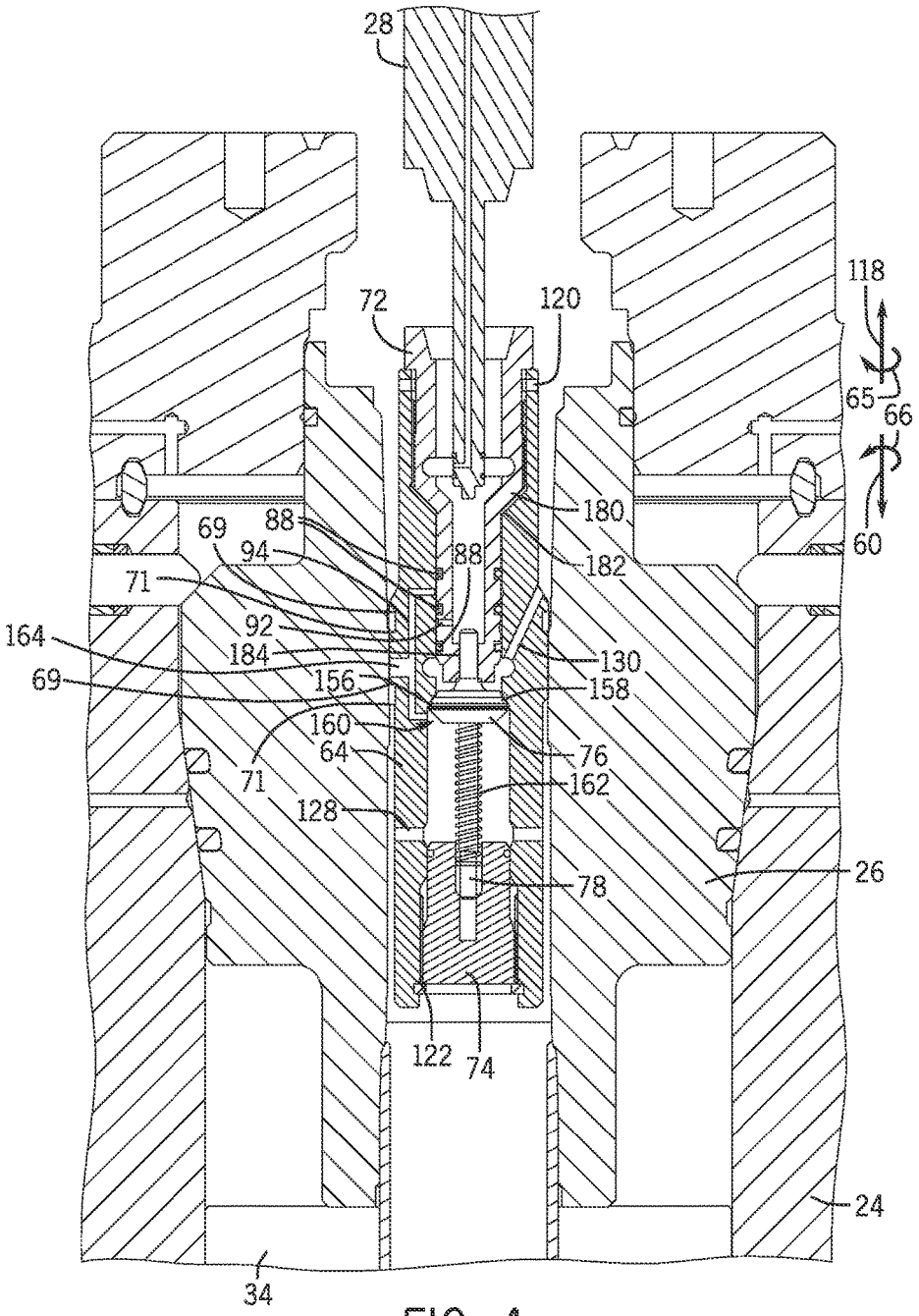
FIG. 4 is a cross-sectional side view of an embodiment of a backpressure valve system in a closed position.

FIG. 4 is a cross-sectional side view of an embodiment of a BPV system 36 in an operational position. After testing the BPV system 36, the running tool 28 rotates the first seal piston 72 in the opposite circumferential direction of that used to place the BPV system 36 in a test position, in order to drive the first seal piston 72 in axial direction 60. As explained above, first seal piston 72 rotates the connecting rod 78, which drives the second seal piston in axial direction 60. The running tool 28 may rotate the first seal piston 72 until the second seal piston 74 contacts the retaining ring 122 and/or a surface 182 (e.g., annular tapered surface) on the first seal piston 72 contacts a ledge or landing 182 (e.g., tapered annular ledge or landing) on the body 64. As the first and second seal pistons 72, 74 move in axial direction 60, the fluid port 94 is misaligned with the test fluid passage 92 and the second seal piston 74 uncovers the apertures 128 (e.g., passages) through the body 64. By misaligning the fluid port 94 and the test fluid passage 92, the BPV system 36 blocks fluid flow from exiting through the test passage 94. Once the apertures 128 open, the running tool 28 uncouples from the first seal piston 72 and the rod or string 30 retracts the running tool 28. As the running tool 28 withdraws from the first seal piston 72, the spring(s) 162 drives the plunger 76 in axial direction 118 (e.g., bias), which in turn drives the connecting rod 78 in axial direction 118. As the connecting rod 78 moves in axial direction 118, the connecting rod 78 extends through an aperture 184 in the first seal piston 72 enabling the plunger 76 to form the seal interface 160. In this position, the plunger 76 forms a seal with the body 64 that blocks fluid flow through the passage 130 in axial direction 118, while still enabling fluid flow through the BPV system 36 in axial direction 60.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a backpressure valve (BPV) system configured to mount in a hydrocarbon extraction system, wherein the BPV system comprises:

a body comprising a vent passage and a test passage, wherein the vent passage extends through the body;

a plunger configured to form a seal with the body around the vent passage; and a first seal piston configured to move between a first position and a second position, wherein the first seal piston fluidly couples a test port with the test passage in the first position, and the first seal piston blocks fluid flow between the test port and the test passage in the second position;

wherein the BPV system is configured to test the seal by pumping a fluid into the body through the test port and the test passage when the first seal piston is in the first position, wherein the system comprises at least one of:

the test passage extends through a side wall of the body to a test chamber having the plunger; or the first seal piston comprises the test port; or a second seal piston configured to move between a third axial position and a fourth axial position to selectively form the test chamber; or a retrievable tool configured to couple to the body of the BPV system, wherein the retrievable tool is configured to move to selectively block or unblock the test passage.

2. The system of claim 1, wherein the test passage extends through the side wall of the body to the test chamber having the plunger.

3. The system of claim 1, wherein the first seal piston is coupled to the body, and the first seal piston comprises the test port.

4. The system of claim 1, wherein the test port is configured to fluidly couple to a fluid passage in a retrievable tool.

5. The system of claim 3, comprising the second seal piston coupled to the body, wherein the second seal piston is configured to move between the third axial position and the fourth axial position to selectively form the test chamber.

6. The system of claim 5, comprising a connecting rod coupled to the first seal piston and to the second seal piston, wherein the connecting rod is configured to transfer torque from the first seal piston to the second seal piston to move the second seal piston from the third axial position to the fourth axial position.

7. The system of claim 1, wherein the test port comprises a radial test port.

8. The system of claim 1, wherein the retrievable tool is configured to couple to the body of the BPV system, and the retrievable tool is configured to move to selectively block and unblock the test passage.

9. A method, comprising:

selectively opening a test passage in a body of a backpressure valve (BPV) system to route a test fluid to a test chamber having a plunger to test a seal between the plunger and a vent passage extending through the body, wherein the plunger is configured to move between an open position of the vent passage and a closed position of the vent passage, and the seal is formed in the closed position, wherein the method further comprises at least one of:

selectively opening the test passage comprises routing the test fluid through the test passage in a side wall of the body to the test chamber; or selectively opening the test passage comprises moving a retrievable tool coupled to the body of the BPV system to unblock the test passage; or selectively opening the test passage comprises moving a first seal piston between a first position and a second position, and selectively closing one or more apertures into the test chamber with a second seal piston that moves from a third position to a fourth position.

10. The method of claim 9, wherein selectively opening the test passage comprises moving the retrievable tool coupled to the body of the BPV system to unblock the test passage.

11. The method of claim 9, wherein selectively opening the test passage comprises moving the first seal piston from the first position to the second position, the test passage is blocked in the first position, and the test passage is unblocked in the second position.

12. The method of claim 11, wherein the first seal piston fluidly couples the test passage with a test port in the second position.

13. The method of claim 11, comprising selectively closing one or more apertures into the test chamber with the second seal piston that moves from the third position to the fourth position.

14. The method of claim 9, wherein selectively opening the test passage comprises routing the test fluid through the test passage in the side wall of the body to the test chamber.

15. The method of claim 9, comprising pumping the test fluid through a retrievable tool coupled to the body and into the test chamber to test the seal between the plunger and the vent passage.

16. A system, comprising:

a hydrocarbon extraction system comprising a component;

a backpressure valve (BPV) system configured to be disposed within the component, comprising:

a body comprising a vent passage and a test passage, wherein the vent passage extends through the body; and a plunger configured to form a seal interface with the body around the vent passage; and a retrievable tool comprising a fluid passage configured to fluidly couple to the test passage, wherein the retrievable tool is configured to direct a test fluid into the BPV system through the test passage and into a test chamber having the plunger to test the seal interface, wherein the system comprises at least one of:

the test passage extends through a side wall of the body to the test chamber having the plunger; or a first seal piston configured to move between a first position and a second position to selectively couple a test port with the test passage, wherein the first seal piston comprises the test port; or the retrievable tool is configured to couple to the body of the BPV system, wherein the retrievable tool is configured to move to selectively block or unblock the test passage.

17. The system of claim 16, wherein the test passage extends through the side wall of the body to the test chamber having the plunger.

18. The system of claim 16, comprising the first seal piston coupled to the body, wherein the first seal piston is configured to move from the first position to the second position, the first seal piston fluidly couples the test port with the test passage in the first position, and the first seal piston blocks fluid flow between the test port and the test passage in the second position, wherein the first seal piston comprises the test port.

19. The system of claim 18, comprising a second seal piston configured to move between a third axial position and a fourth axial position to selectively form the test chamber.

20. The system of claim 16, wherein the retrievable tool is configured to move to selectively block and unblock the test passage.

* * * * *